US008009114B2

(12) United States Patent
Hauhe et al.

(10) Patent No.: US 8,009,114 B2
(45) Date of Patent: Aug. 30, 2011

(54) FLEXIBLE TRANSMIT/RECEIVE ANTENNA PAIR USING A SWITCHABLE 0°/180° PHASE SHIFTER

(75) Inventors: Mark Hauhe, Hermosa Beach, CA (US); Clifton Quan, Arcadia, CA (US)

(73) Assignee: Raytheon Company, Waltham, MA (US)

( * ) Notice: Subject to any disclaimer, the term of this patent is extended or adjusted under 35 U.S.C. 154(b) by 241 days.

(21) Appl. No.: 12/405,132

(22) Filed: Mar. 16, 2009

(65) Prior Publication Data

US 2010/0231325 A1 Sep. 16, 2010

(51) Int. Cl.
*H01Q 3/44* (2006.01)
*H01P 1/18* (2006.01)

(52) U.S. Cl. ..... 343/754; 333/164; 333/161; 333/4

(58) Field of Classification Search ..... 333/139, 333/156, 161, 164, 4, 5; 343/753, 754
See application file for complete search history.

(56) References Cited

U.S. PATENT DOCUMENTS

| | | | | |
|---|---|---|---|---|
| 3,045,237 | A | 7/1962 | Marston | |
| 3,305,867 | A | 2/1967 | Miccioli et al. | |
| 3,568,184 | A | 3/1971 | Drabowitch | |
| 3,971,022 | A * | 7/1976 | Lenz | 343/754 |
| 4,939,527 | A * | 7/1990 | Lamberty et al. | 343/771 |
| 4,992,761 | A | 2/1991 | Seely et al. | |
| 5,355,104 | A | 10/1994 | Wolfson et al. | |
| 5,680,079 | A * | 10/1997 | Inami et al. | 333/161 |
| 5,680,471 | A | 10/1997 | Kanebako et al. | |
| 6,797,891 | B1 * | 9/2004 | Blair et al. | 174/268 |
| 2005/0264448 | A1 | 12/2005 | Cox et al. | |
| 2008/0030413 | A1 | 2/2008 | Lee et al. | |
| 2008/0197936 | A1 * | 8/2008 | Berg | 333/103 |

OTHER PUBLICATIONS

European Search Report for European Application No. 10 442.0-1248, European Search Report dated Jun. 8, 2010 and mailed Jun. 15, 2010 (5 pgs.).

* cited by examiner

*Primary Examiner* — Benny Lee
(74) *Attorney, Agent, or Firm* — Christie, Parker & Hale, LLP

(57) ABSTRACT

A switchable 0°/180° phase shifter on a balanced transmission line is provided. In one embodiment, the invention relates to an apparatus for providing 0°/180° phase shifting for a transmit/receive antenna pair including a transmit element and a receive element coupled by a balanced transmission line having two sections, the apparatus including a first section of the balanced transmission line, the first section including a first conductor and a second conductor, a second section of the balanced transmission line, the second section including a third conductor and a fourth conductor, and a switch disposed between the first section and the second section, wherein in a first configuration, the switch couples the first conductor to the third conductor and the second conductor to the fourth conductor, and in a second configuration, the switch couples the first conductor to the fourth conductor and the second conductor to the third conductor.

25 Claims, 7 Drawing Sheets

FLEXIBLE TRANSMIT/RECEIVE ANTENNA PAIR USING A SWITCHABLE 0°/180° PHASE SHIFTER

CROSS-REFERENCE TO RELATED APPLICATION

The present invention is related to U.S. patent application Ser. No. 12/405,135, entitled Light Weight Stowable Antenna Lens Assembly, filed concurrently herewith on Mar. 16, 2009, the entire content of which is incorporated herein by reference.

BACKGROUND

1. Field of the Invention

The present invention relates to the field of microwave transmission lines and, more particularly, to an antenna lens array phase shifter for balanced microwave transmission lines.

2. Description of Related Art

State of the art phase array antennas need to be light weight and physically flexible for reusable deployment and stowage in a space and near-space environments. In some conventional dipole antenna arrays, power dividers couple each of the dipole antennas by unbalanced cables to a common transmit/receive point. Conventional unbalanced microwave transmission lines can include microstrip, waveguide, and coaxial transmission lines.

Conventional dipole antenna arrays often include conventional phase shifters having unbalanced line inputs/outputs such that additional circuitry is needed to transition, for example, to each of the balanced line dipole feeds. When using a conventional phase shifter with a balanced transmission line, a balanced-unbalanced (balun) transition is needed on the input side and the output side of the phase shifter as the balanced transmission line is coupled to both sides of the conventional unbalanced phase shifter. However, use of at least two baluns per conventional phase shifter for each antenna lens element pair results in increased size, weight and cost per element. As such, a need exists for a system and method for interfacing phase shifters to balanced transmission lines without the need for balun transitions.

SUMMARY OF THE INVENTION

Since state of the art phase array antennas need to be light weight, physically flexible for reusable deployment and stowage in a space and near-space environment, and since a key component to the state of the art antennas is the phase shifter, embodiments of the present invention provide a wideband microwave switchable 0 or 180 degrees phase shifter on a thin flexible coplanar strip (CPS) transmission line. In accordance with embodiments of the present invention, the thin flexible CPS transmission line is used as the principle transmission media to effect a switchable 0/180 degrees phase shift on the microwave signal while interfacing directly an antenna radiator without the need for a balun transition.

Embodiments of the present invention are directly applicable to current as well as future microwave systems and significantly improve upon current approaches by providing an ultra light-weight phased array lens antenna for space and near-space based platforms. Embodiments of the present invention are particularly suited for today's environment demanding thinner, lighter and better performing radar and communication systems, as well as other sensors and support equipment.

In one embodiment, the invention relates to an apparatus for providing 0°/180° phase shifting for a transmit/receive antenna pair including a transmit element and a receive element coupled by a balanced transmission line having two sections, the apparatus including a first section of the balanced transmission line, the first section including a first conductor and a second conductor, a second section of the balanced transmission line, the second section including a third conductor and a fourth conductor, and a switch disposed between the first section and the second section, wherein in a first configuration, the switch couples the first conductor to the third conductor and the second conductor to the fourth conductor, and in a second configuration, the switch couples the first conductor to the fourth conductor and the second conductor to the third conductor.

In another embodiment, the invention relates to a method for providing 0°/180° phase shifting for a transmit/receive antenna pair including a transmit element and a receive element, the method including coupling a balanced transmission line between the transmit element and the receive element of the transmit/receive antenna pair, the balanced transmission line including a first section including a first conductor and a second conductor, and a second section including a third conductor and a fourth conductor, switching a switch disposed between the first section and the second section to a first configuration, wherein the switch couples the first conductor to the third conductor and the second conductor to the fourth conductor, or switching the switch to a second configuration, wherein the switch couples the first conductor to the fourth conductor and the second conductor to the third conductor.

DETAILED DESCRIPTION OF THE INVENTION

Figure 1:
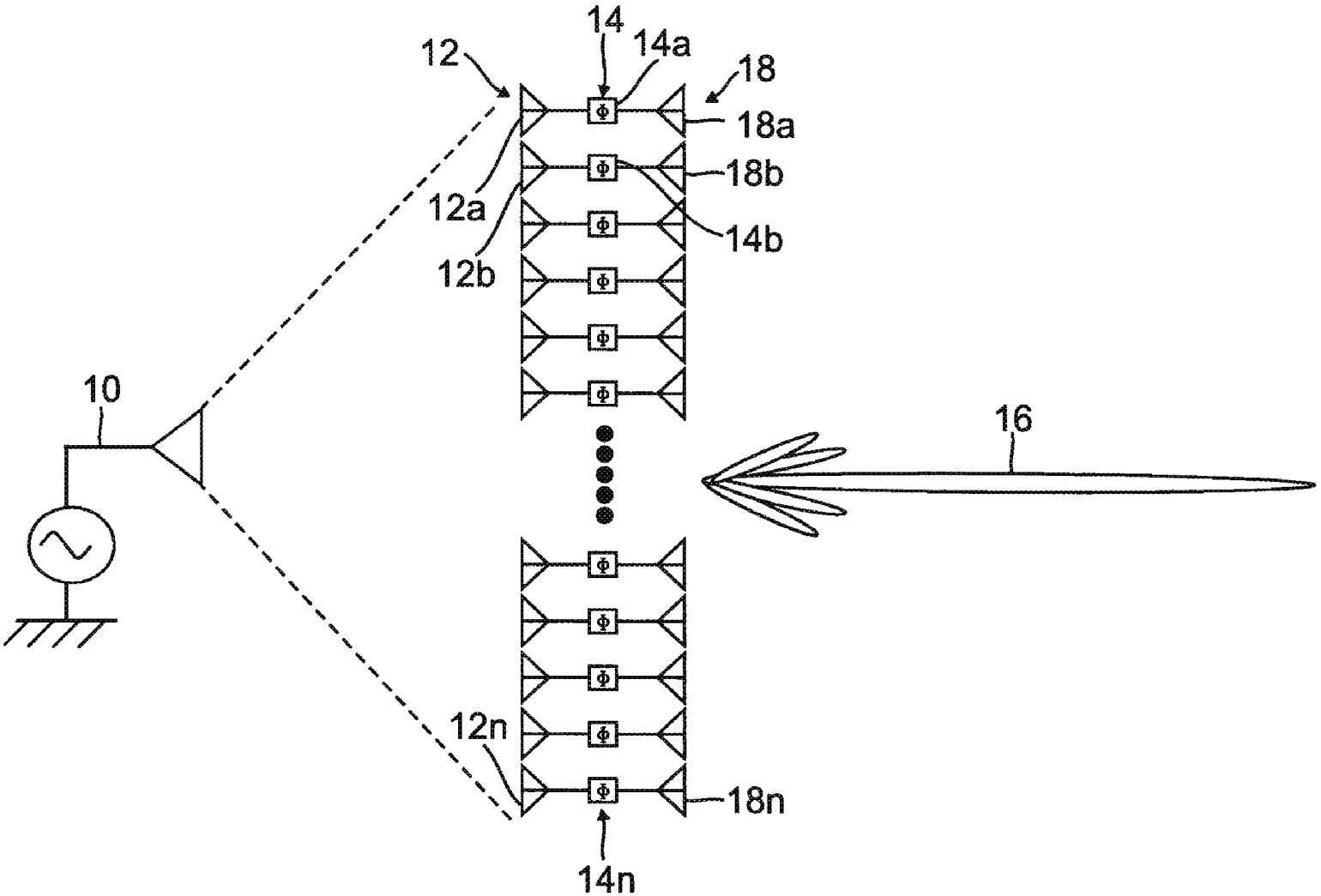
FIG. 1 is a schematic block diagram of an antenna lens array having a plurality of phase shifting switches along balanced transmission lines between dipole antenna elements in accordance with one embodiment of the present invention.

Referring now to the drawings where like features are denoted by the same reference numbers throughout the drawings, embodiments of phase shifting switches disposed between sections of balanced transmission lines used for coupling radiating elements of antenna pairs provide 0 degrees or 180 degrees phase shifting. Embodiments of the phase shifting switches have a first configuration, or pass through configuration, providing 0 degrees phase shift. The embodiments of phase shifting switches also have a second configuration, or crossover configuration, providing 180 degrees phase shift. In a number of embodiments, the balanced transmission lines are coplanar strip transmission lines. In several embodiments, the coplanar strip transmission lines and phase shifting switches are disposed on flexible feed cables used for coupling radiating elements of the antenna pairs. In a number of embodiments, the phase shifting switches provide 0 degrees or 180 degrees phase shifting for the antenna pairs without requiring one or more baluns.

FIG. 1 is a schematic block diagram of an antenna lens array having a plurality of phase shifting switches along balanced transmission lines between dipole antenna elements in accordance with one embodiment of the present invention. In the antenna lens array, rather than having power dividers couple each of the dipole antennas by unbalanced cables to a common transmit/receive point, a remote horn 10, or other radiating antenna, illuminates a first group of dipole antennas 12. Energy captured by the first group of dipole antennas 12 is then fed by balanced transmission lines, such as coplanar strip (CPS) transmission lines, to circuitry, such as phase shifters (e.g., phase shifting switches) 14, for processing before it is again fed by balanced transmission lines for the transmitting of a composite antenna beam 16 from a second group of dipole antennas 18.

In the embodiment illustrated in FIG. 1, radiators 12*a*, 12*b* . . . 12n form first group 12. Another group of radiators 18*a*, 18*b* . . . 18n form second group 18. Corresponding phase shifting switches 14*a*, 14*b*, . . . 14n are disposed between each respective transmit and receive radiators. The phase shifters, or phase shifting switches, are used to steer the composite antenna beam 16 resulting from the combination of transmit radiators. A phase front can be created or delayed on each element so that collectively the phase front tilts. In other embodiments, other configurations of dipole antennas can be used.

Figures 2A, 2B, 2C:
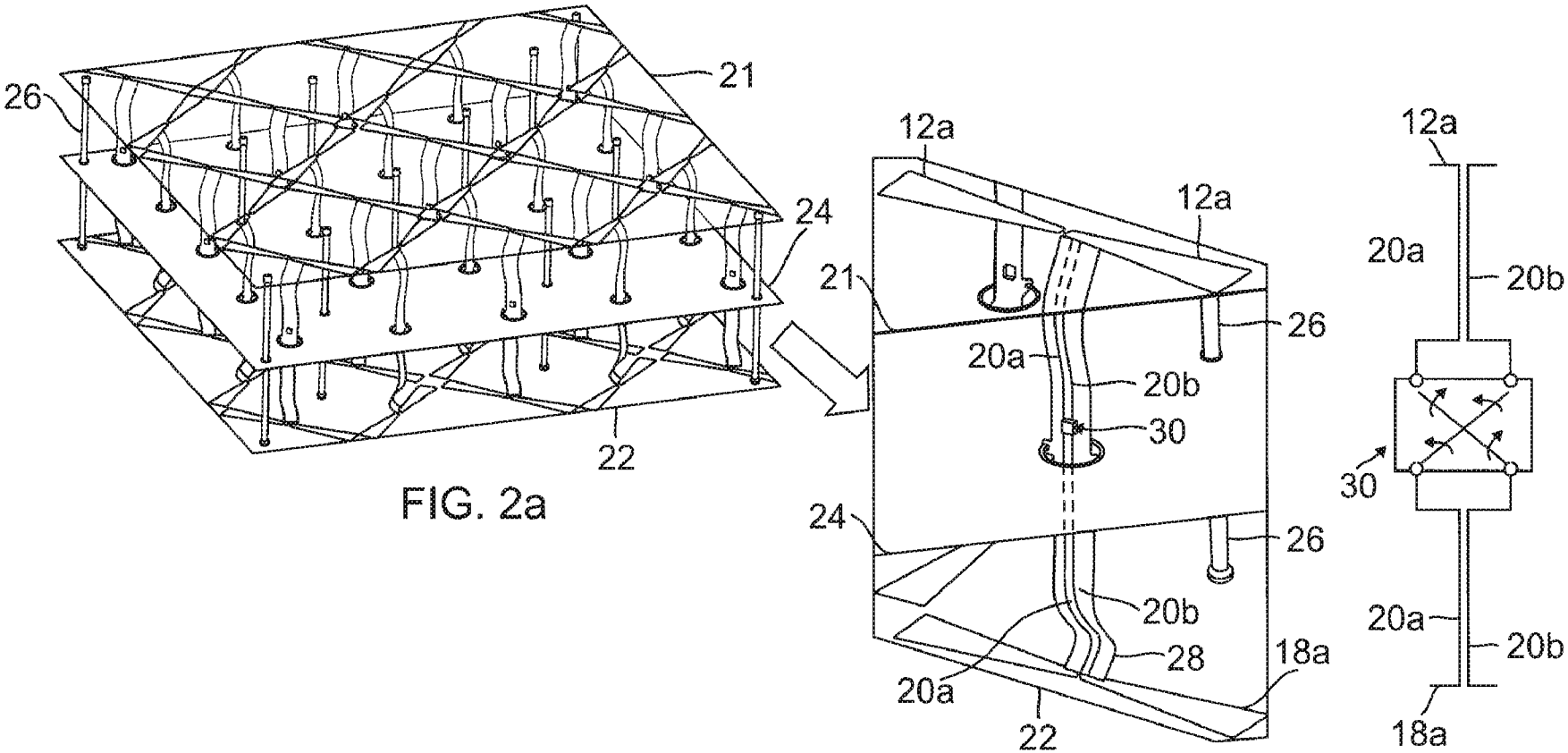
FIG. 2*a* is a perspective view of a portion of an antenna structure that can be used in conjunction with the antenna lens array of FIG. 1 in accordance with one embodiment of the present invention.
FIG. 2*b* is a perspective view of a portion of the antenna structure of FIG. 2*a* including a single transmit/receive dipole antenna pair coupled by a flexible coplanar strip (CPS) transmission line having a phase shifting switch in accordance with one embodiment of the present invention.
FIG. 2*c* is a schematic diagram of the phase shifting switch of FIG. 2*b*.

FIG. 2*a* is a perspective view of a portion of an antenna structure that can be used in conjunction with the antenna lens array of FIG. 1 in accordance with one embodiment of the present invention. The antenna structure includes a top layer 21 including a number of radiating elements, a middle layer 24 including a ground plane, and a bottom layer 22 including a number of radiating elements. The antenna structure further includes a number of dipole antenna pairs, where each pair includes a first radiating element on the top layer 21, a second radiating element on the bottom layer 22, and a flexible feed cable that couples the first radiating element to the second radiating element. The flexible cables also couple the radiating elements to control signals routed on the middle layer 24. The top, middle and bottom layers are physically and electrically isolated using a plurality of graphite posts 26 disposed between the layers.

FIG. 2*b* is a perspective view of a portion of the antenna structure of FIG. 2*a* including a single transmit/receive dipole antenna pair coupled by a flexible coplanar strip (CPS) transmission line having a phase shifting switch in accordance with one embodiment of the present invention. Each of the radiating elements (12*a*, 18*a*) of the transmit/receive antenna pair is located on a separate sheet (21, 22) with a middle layer/ground plane sheet 24 disposed therebetween. The sheets (21, 22) are separated, both physically and electrically, from middle layer/ground plane 24 by graphite posts 26. A balanced transmission line 28, having conductors (20*a*, 20*b*), interconnects the transmit/receive antenna pair (12*a*, 18*a*) and includes phase shifter 14*a*.

Each of the sheets 21, 22, 24 can be made of a multi-layer flexible material. The multi-layer flexible composite material is described in detail in the co-pending application "Light Weight Stowable Antenna Lens Assembly", U.S. patent application Ser. No. 12/405,135, filed concurrently on Mar. 16, 2009 and incorporated herein by reference. In some embodiments, the multi-layer material includes a 0.0005 inch thick polyimide film, such as Dupont's KAPTON ® film, on a bottom layer, a 0.0005 inch thick polyimide film, such KAPTON ® film, on a top layer with a 0.0005 thick inch 400 Denier patterned aromatic polyester fiber, such as VECTRAN fiber, as a middle layer sandwiched between the top and bottom layers. Adhesive, such as PYRALUX adhesive made by Dupont, is disposed on the surfaces of the bottom and top layers that face the middle layer and on both surfaces of the middle layer. These reinforced plastic sheets bond together to form a composite structure.

The bottom and top layers of the multi-layer flexible material allow the transfer of sheer load through the sheets, hold the fiber layer in place, and provide a surface that can be plated or printed on. The fiber layer provides tensile strength and a rip stop in case the sheet is punctured and begins to tear. The completed reinforced plastic sheet is soft and can be folded easily. As such, each of the sheets is very thin, flexible, strong and not prone to tearing or stretching. As such, it can provide an excellent platform for an antenna pattern. In other embodiments, other configurations of dipole antennas can be used.

FIG. 2*c* is a schematic diagram of the phase shifting switch 30 of FIG. 2*b*. The phase shifting switch 30 can be used with a dipole antenna pair of an antenna lens array in accordance with the present invention. In some embodiments, the dipole antenna pair is one of the antenna pairs of the antenna lens array of FIG. 1. In such case, each of the remaining pairs of the antenna lens array can be similarly implemented to form the antenna lens array in accordance with the present invention.

Figures 2D, 2E:
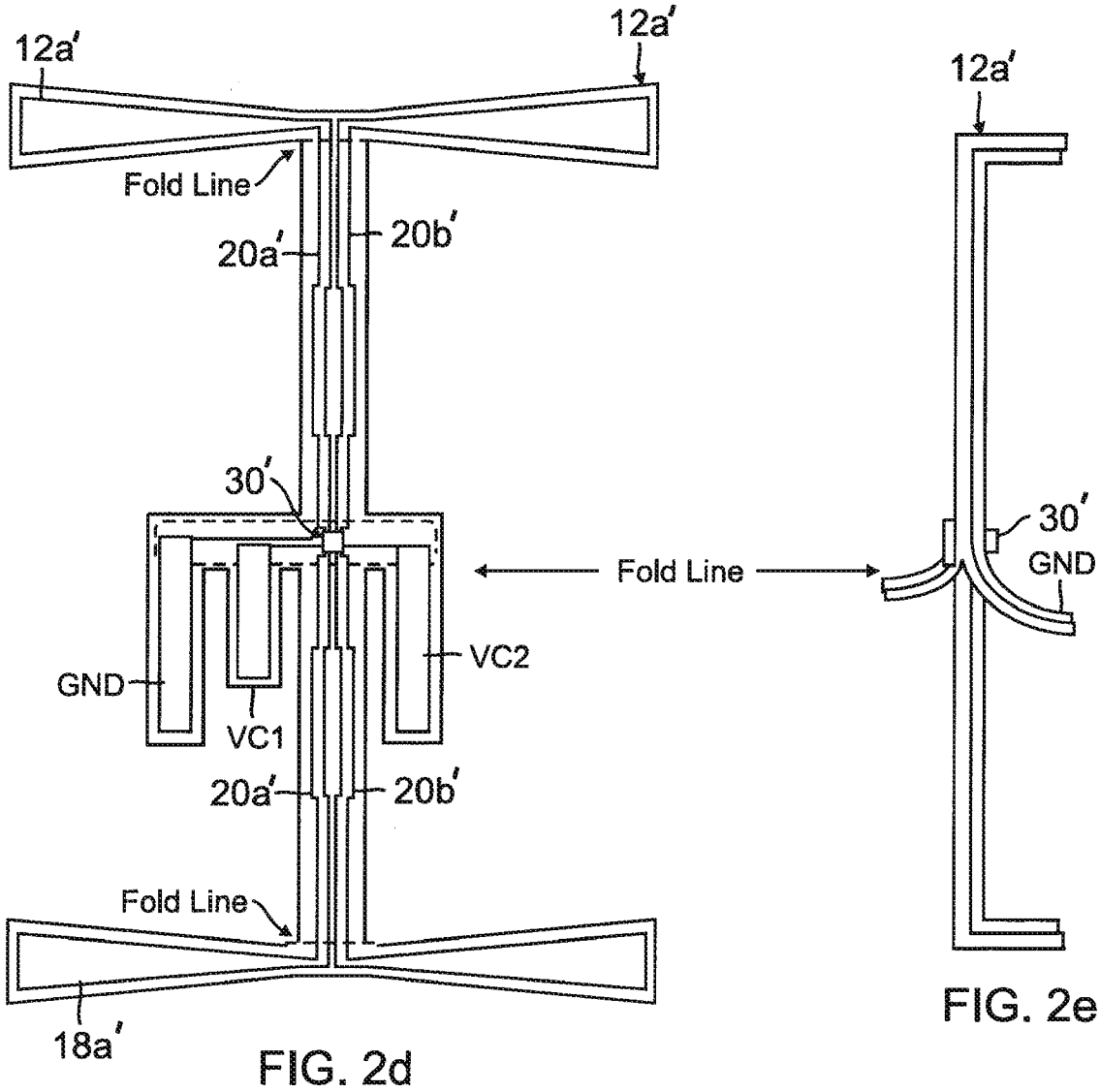
FIG. 2*d* is a top view of a single transmit/receive dipole antenna pair coupled by a flexible feed cable that can be used in conjunction with the antenna structures of FIG. 2*a* and FIG. 2*b*.
FIG. 2*e* is a side view of the single transmit/receive dipole antenna pair coupled by the flexible feed cable of FIG. 2*d*.

FIG. 2*d* is a top view of a single transmit/receive dipole antenna pair coupled by a flexible feed cable that can be used in conjunction with the antenna structures of FIG. 2*a* and FIG. 2*b*. The dipole antenna pair includes a first radiating element 12*a*' and a second radiating element 18*a*' coupled by conductors (20*a*', 20*b*') of the flexible feed cable. The flexible feed cable also includes a phase shifting switch 30' disposed approximately midway between the radiating elements (12*a*', 18*a*') along a top side of the flexible feed cable. The flexible feed cable further includes a first flexible flap GND for coupling with a ground plane, a second flexible flap VC1 for coupling with a first switch control voltage, and a third flexible flap VC2 for coupling with a second switch control voltage. The flexible flaps can be folded about fold lines to make connections with various signals on the middle layer 24 of the antenna structure (see FIGS. 2*a* and 2*b*). In some embodiments, the middle layer 24 has a ground plane on one side of the layer and control signals, such as the switch control signals, routed on the other side of the middle layer. The flexible flaps (GND, VC1, VC2) can be bent or folded in order to physically couple the phase shifting switch with appropriate connection points (not shown) on the middle layer.

The radiating elements and conductors on the flexible feed cable can be formed of conductive metals that have been deposited or etched onto the cable. In many embodiments, the flexible feed cable is made of KAPTON ® film or another suitable flexible material for electrical circuitry. FIG. 2*e* is a side view of the single transmit/receive dipole antenna pair coupled by the flexible feed cable of FIG. 2*d*.

Figure 3:
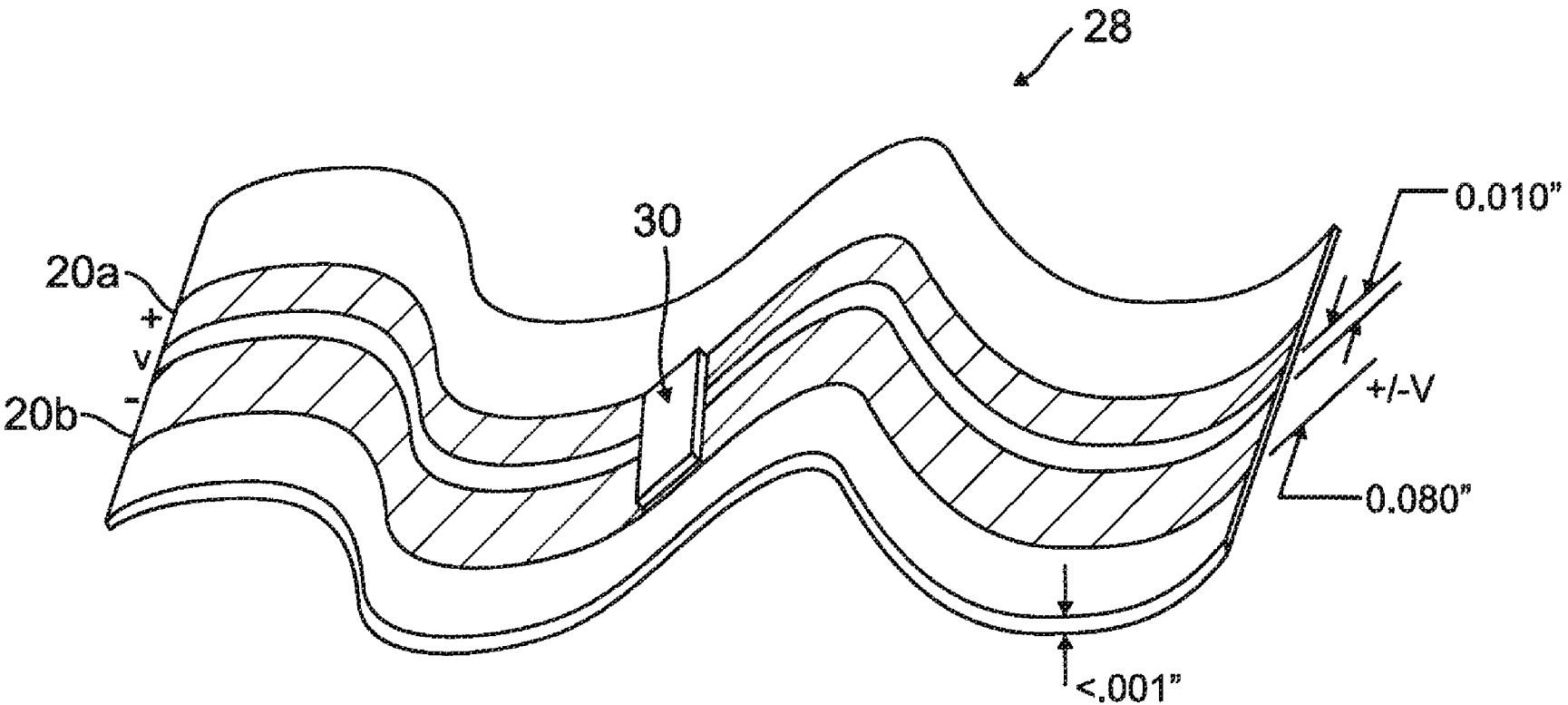
FIG. 3 is a perspective view of a portion of a flexible feed cable including a CPS transmission line and a phase shifting switch disposed thereon in accordance with one embodiment of the present invention.

FIG. 3 is a perspective view of a portion of a flexible feed cable 28 including a CPS transmission line and a phase shifting switch 30 disposed thereon in accordance with one embodiment of the present invention. Because weight and flexibility are primary concerns for present and future antenna lens arrays, the balanced transmission line chosen is a coplanar strip on a thin flexible film substrate. The electromagnetic field configuration is also compatible with many radiating antenna elements such as dipoles, slots and flared notches.

The CPS transmission line consists of two conductors (20*a*, 20*b*) of the same type. These balanced lines are often operated with differential signals, where one signal is the inverse of the other (+/−V). The CPS impedance is determined by a combination of factors including the conductor width (e.g. 0.0010 inches), the spacing separating the two conductors (e.g. 0.080 inches), the flexible substrate thickness (e.g. <0.001 inches), and the dielectric constant "er". Because of the configuration of electromagnetic fields across the transmission line illustrated in FIG. 3, formed during operation of the CPS, the substrate can be as thin as 0.00025 inches without significant impact upon the conductor width and gap dimensions. The coplanar strips can thus be designed to be extremely light weight and flexible.

In one embodiment of CPS balanced lines, the two strip line conductors (20*a*, 20*b*) are situated on a dielectric, such as a reduced weight flexible thin film, to interconnect, respectively, a transmit dipole radiator and a receive dipole radiator combination. The separation, the width, thickness of the conductors dictates the impedance of the transmission lines. Such a thin configuration allows the transmission line to be foldable, thereby allowing for collapsible/expandable configurations. Incorporating a wideband low loss phase shifter circuit directly with the thin and flexible transmission lines without impacting the weight and flexibility allows beam steering without affecting the overall size and weight of the antenna.

In the embodiment illustrated in FIG. 3, the CPS transmission line includes two conductors. In other embodiments, more than or less than two conductors can be used. In such case, additional phase shifting switches or phase shifting switches having fewer or additional contacts can be used. In the embodiment illustrated in FIG. 3, the flexible feed cable and CPS transmission line disposed thereon have specific dimensions. In other embodiments, the flexible feed cable and CPS transmission line can have other suitable dimensions. In one embodiment, the transmission line is a microstrip.

Figure 4A:
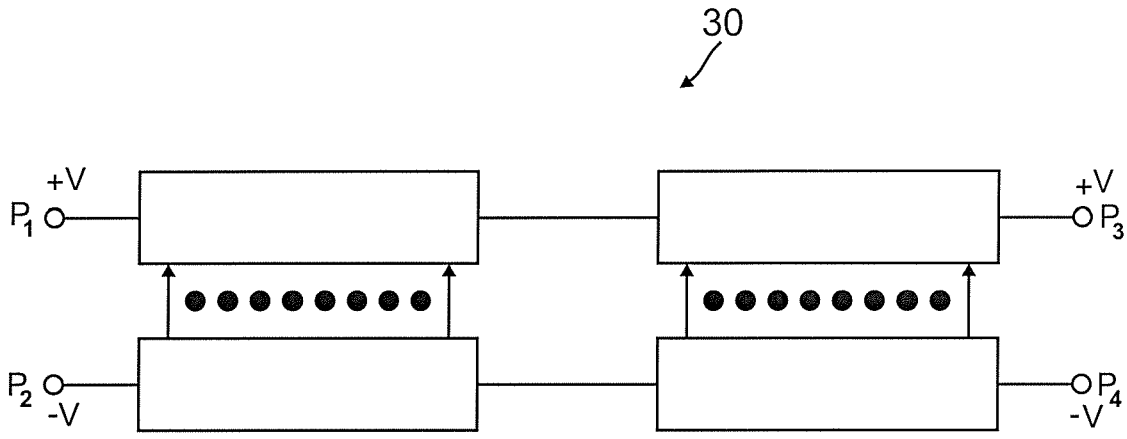
FIGS. 4*a* and 4*b* are schematic block diagrams illustrating respectively a 0° switching path and a 180° switching path for a balanced transmission line in accordance with the present invention.
Figure 4B:
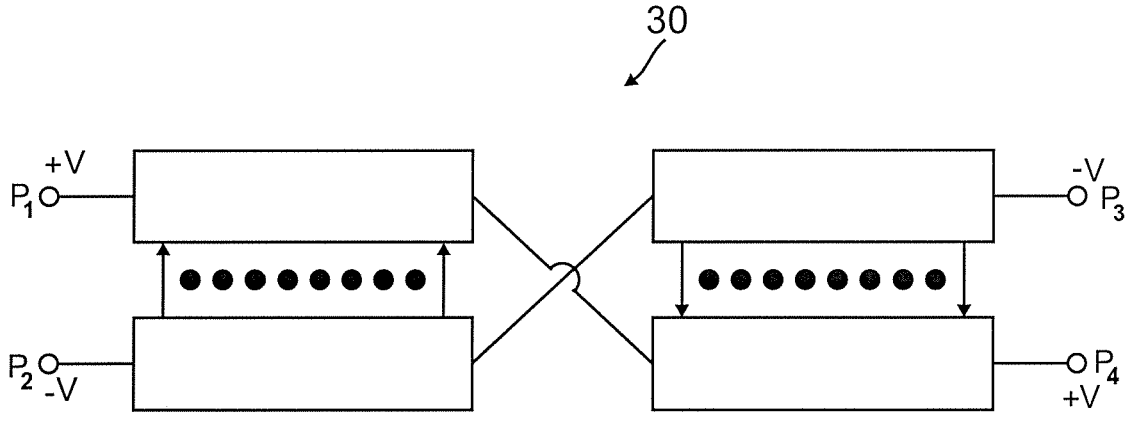

FIGS. 4*a* and 4*b* are schematic block diagrams illustrating respectively a 0 degree switching path and a 180 degree switching path for a balanced transmission line in accordance with the present invention. In FIG. 4*a*, a first signal, a "+V" which is applied to port P1, and a second signal, a "−V" which is applied to port P2, pass through the switch 30 at ports P3 and P4, respectively, with a 0 degrees phase shift when the switch is in an unswitched state. In FIG. 4*b*, the first signal, a "+V" which is applied to port P1, and the second signal, a "−V" which is applied to port P2, are switched to ports P4 and P3, respectively, providing a 180 degrees phase shift when the switch 30 is in a switched state.

While not bound by any particular theory, the strips/conductors of the transmission line (see FIG. 3) can produce an even mode electric field when excited in phase and an odd mode electric field when excited in anti-phase relationship. A discussion of even mode and odd mode electric fields can be found in U.S. Pat. No. 5,355,104 to Wolfson et al., the entire content of which is expressly incorporated herein by reference. Normally, both strips/conductors are fed in phase and therefore operate in the even mode. However, it some circumstances, the odd mode, which is usually undesirable, is the preferred mode of operation. In the embodiment illustrated in FIGS. 4*a* and 4*b*, the odd mode is preferred. By not tying the ground plane of the switch 30 to the RF lines within the CPS, such as in the phase shifting switch of FIG. 2*b*, the CPS lines can be routed as shown in FIGS. 4*a* and 4*b* to realize the 180° phase shift while maintaining the odd mode.

Figure 5:
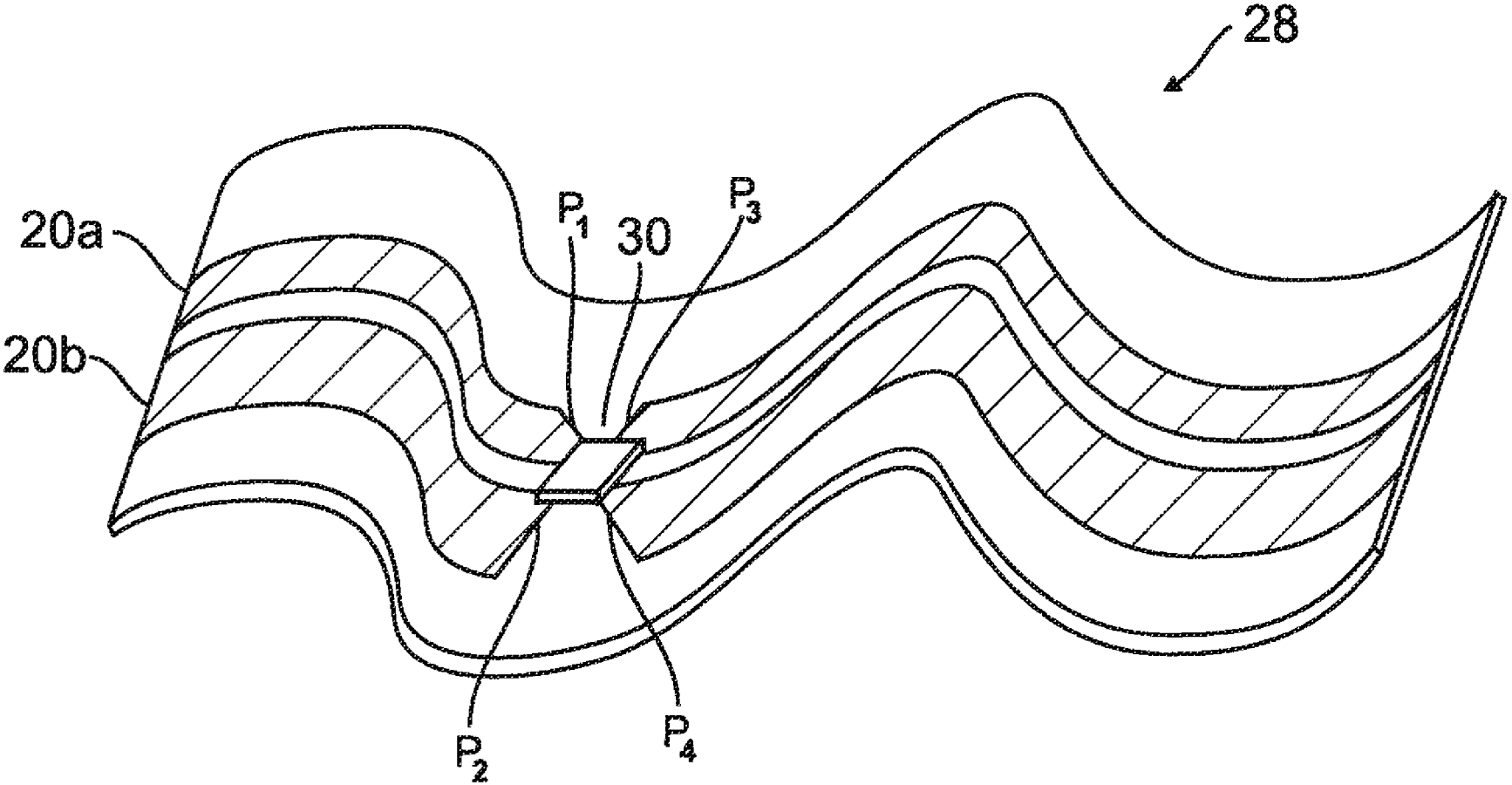
FIG. 5 is a perspective view of a portion of a flexible feed cable having a CPS transmission line and a phase shifting switch disposed thereon in accordance with one embodiment of the present invention.

FIG. 5 is a perspective view of a portion of a flexible feed cable 28 having a CPS transmission line and a phase shifting switch 30 disposed thereon in accordance with one embodiment of the present invention. The phase shifting switch 30 is a DPDT switch coupled between a first section and a second section of the CPS transmission line conductors (20*a*, 20*b*) and provides the switching functionality as depicted in FIGS. 4*a* and 4*b*. The first section includes ports P1 and P2, and the second section includes ports P3 and P4.

Typical devices used for this DPDT switch at microwave frequencies include PIN diodes, Field Effect Transistors (FETs), and micro-electromagnetic switch systems (MEMS). A microwave PIN diode is a semiconductor device that operates as a variable resistor at RF and microwave frequencies. Such microwave frequency switches have been used for switching multiple external antennas between a common transmitter and receiver as in the case of the 2.5 GHz and 3.5 GHz WiMax, WLAN MESH networks, fixed wireless access and other power systems. For such applications, these switches are typically configured for use on unbalanced transmission lines that require a ground plane. As contrasted with these uses, many of the phase shifting switches described herein are used with balanced transmission lines and generally do not require a ground plane. In the embodiment illustrated in FIG. 5, the phase shifting switch and balanced transmission line are implemented on a flexible substrate. In other embodiments, the phase shifting switch and balanced transmission line are implemented on other suitable substrates.

Figure 6:
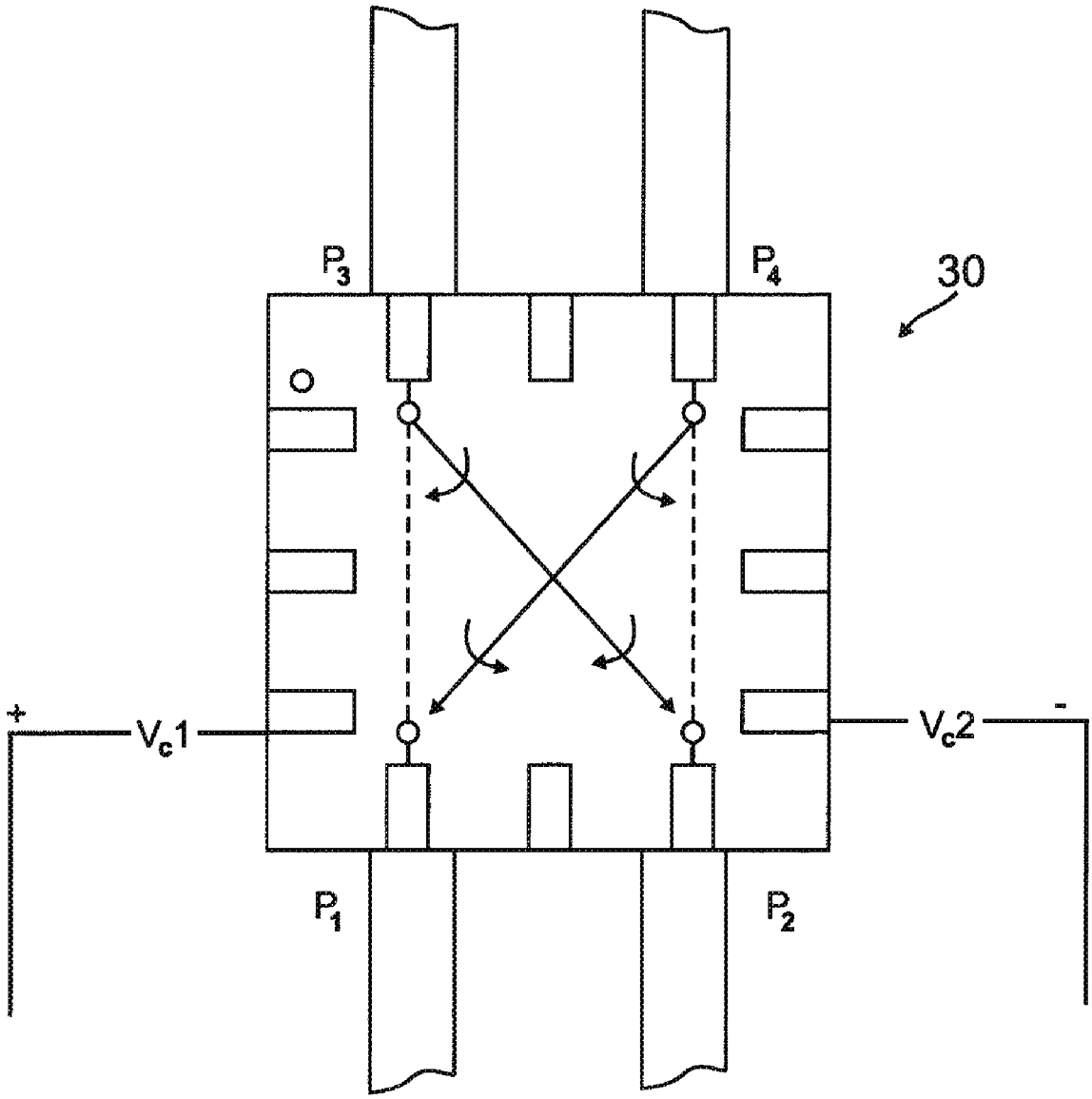
FIG. 6 is a schematic block diagram of a DPDT microwave switch adapted for use in accordance with the present invention.

FIG. 6 illustrates a schematic block diagram of a DPDT switch 30 adapted for use in accordance with the present invention. The DPDT switch 30 is implemented using a MASW-007587 switch, made by M/A-COM of Lowell, Mass., adapted for insertion into the path of two parallel transmission line conductors (e.g., conductors 20*a*, 20*b* of FIG. 5) to provide the P1, P2, P3, P4 port switching. Positive and negative (+/−) DC voltages are applied at ports $V_c$1 and $V_c$2 to control operation of the switch by commanding the desired phase shift. In several embodiments, the ground(s) of the switch are coupled to bias control voltage as a return while the RF lines/conductors are isolated from the ground.

Although the present invention has been described with reference to the exemplary embodiments thereof, it will be appreciated by those skilled in the art that it is possible to modify and change the present invention in various ways without departing from the spirit and scope of the present invention as set forth in the following claims. For example, besides flexible CPS, other balanced transmission configurations may be considered, such as slotline, conductor-backed CPS, and twin lead, which is also known as "2-wire" line. As alternative examples with regard to the dipole antenna embodiments, flared notch radiators, flared dipole radiators, long slot radiators, and the like, may also be used.

What is claimed is:

1. An apparatus for providing 0° /180° phase shifting for a transmit/receive antenna pair, the apparatus comprising:
a transmit radiating element positioned on a first flexible sheet;
a receive radiating element positioned on a second flexible sheet spaced apart from the first flexible sheet;
a balanced transmission line having two sections coupling the transmit radiating element and the receive radiating element, the two sections comprising:
a first section comprising a first conductor and a second conductor; and
a second section comprising a third conductor and a fourth conductor; and
a switch disposed between the first section and the second section, wherein:
in a first configuration, the switch couples the first conductor to the third conductor and the second conductor to the fourth conductor; and
in a second configuration, the switch couples the first conductor to the fourth conductor and the second conductor to the third conductor.

2. The apparatus of claim 1:
wherein the first section is coupled to the transmit radiating element; and
wherein the second section is coupled to the receive radiating element.

3. The apparatus of claim 1, wherein the balanced transmission line is a coplanar strip transmission line.

4. The apparatus of claim 3, wherein the coplanar strip transmission line is disposed on a thin flexible cable.

5. The apparatus of claim 1, wherein the transmit/receive antenna pair comprises a pair of dipole antennas.

6. The apparatus of claim 1, wherein an antenna lens array is comprised of a plurality of the phase shifting apparatuses.

7. The apparatus of claim 1, wherein the switch is a double pole double throw switch.

8. The apparatus of claim 1, wherein the switch is configured to switch signals at microwave frequencies.

9. The apparatus of claim 1, wherein the switch:
provides, in the first configuration, zero degrees phase shift; and
provides, in the second configuration, 180 degrees phase shift.

10. The system of claim 1:
wherein the first flexible sheet and the second flexible sheet comprises a composite material comprising:
a first outer layer comprising a polymeric film,
a second outer layer comprising a polymeric film, and
a middle layer sandwiched between the first outer layer and the second outer layer, the middle layer comprising a patterned reinforcing material.

11. The system of claim 10, wherein the composite material further comprises:
a first adhesive layer disposed between the first outer layer and the middle layer; and
a second adhesive layer disposed between the middle layer and the second outer layer.

12. The system of claim 1:
wherein the first flexible sheet comprises a first polymeric film, and
wherein the second flexible sheet comprises a second polymeric film.

13. The system of claim 1, wherein a third flexible sheet is positioned between, and spaced apart from, the first flexible sheet and the second flexible sheet, the third flexible sheet comprising a ground plane.

14. A method for providing 0°/180° phase shifting for a transmit/receive antenna pair comprising a transmit radiating element and a receive radiating element, the method comprising:
coupling a balanced transmission line between the transmit radiating element positioned on a first flexible sheet and the receive radiating element positioned on a second flexible sheet spaced apart from the first flexible sheet, the balanced transmission line comprising:
a first section comprising a first conductor and a second conductor; and
a second section comprising a third conductor and a fourth conductor; and
switching a switch disposed between the first section and the second section to a first configuration or a second configuration,
wherein, in the first configuration, the switch couples the first conductor to the third conductor and the second conductor to the fourth conductor and
wherein, in the second configuration, the switch couples the first conductor to the fourth conductor and the second conductor to the third conductor.

15. The method of claim 14, wherein the switch is a double pole double throw switch.

16. The method of claim 14, wherein the switch is configured to switch signals at microwave frequencies.

17. The method of claim 14, wherein the switch:
provides, in the first configuration, zero degrees phase shift; and
provides, in the second configuration, 180 degrees phase shift.

18. The method of claim 14:
wherein the first flexible sheet comprises a first polymeric film, and
wherein the second flexible sheet comprises a second polymeric film.

19. The method of claim 14, wherein a third flexible sheet is positioned between, and spaced apart from, the first flexible sheet and the second flexible sheet, the third flexible sheet comprising a ground plane.

20. The method of claim 14:
wherein the first flexible sheet and the second flexible sheet comprises a composite material comprising:
a first outer layer comprising a polymeric film,
a second outer layer comprising a polymeric film, and
a middle layer sandwiched between the first outer layer and the second outer layer, the middle layer comprising a patterned reinforcing material.

21. The method of claim 20, wherein the composite material further comprises:
a first adhesive layer disposed between the first outer layer and the middle layer; and
a second adhesive layer disposed between the middle layer and the second outer layer.

22. The method of claim 14, wherein the balanced transmission line is a coplanar strip transmission line.

23. The method of claim 22, wherein the coplanar strip transmission line is disposed on a flexible flat cable.

24. The method of claim 14, wherein the transmit/receive antenna pair comprises a pair of dipole antennas.

25. The method of claim 14:
wherein the first section is coupled to the transmit radiating element; and
wherein the second section is coupled to the receive radiating element.

* * * * *